United States Patent [19]

Brunner et al.

[11] Patent Number: 4,505,808

[45] Date of Patent: Mar. 19, 1985

[54] METHOD OF EXTRACTING HYDROCARBONS FROM OIL-CONTAINING ROCK OR SAND THROUGH HYDROGENATING LOW TEMPERATURE CARBONIZATION

[75] Inventors: Gerd Brunner, Roth; Rainer Hoffmann, Nuremburg; Konrad Künstle, Röttenbach, all of Fed. Rep. of Germany

[73] Assignee: Kraftwerk Union Aktiengesellschaft, Mülheim/Ruhr, Fed. Rep. of Germany

[21] Appl. No.: 532,826

[22] Filed: Sep. 15, 1983

[30] Foreign Application Priority Data

Sep. 29, 1982 [DE] Fed. Rep. of Germany ..... 3236504

[51] Int. Cl.[3] ..... C10B 53/06; C10G 1/02; C10G 21/06

[52] U.S. Cl. ..... 208/11 R; 208/177

[58] Field of Search ..... 208/11 R, 8 R, 177, 208/251 R

[56] References Cited

U.S. PATENT DOCUMENTS

| | | | |
|---|---|---|---|
| 3,617,472 | 11/1971 | Schlinger et al. | 208/11 R |
| 3,817,723 | 6/1974 | Donath | 208/8 R X |
| 3,960,700 | 6/1976 | Rosen et al. | 208/11 R X |
| 3,988,237 | 10/1976 | Davis et al. | 208/8 R |
| 4,040,958 | 8/1977 | Rammler | 208/177 X |
| 4,162,959 | 7/1979 | Duraisuamy | 208/8 R |
| 4,164,466 | 8/1979 | Baldwin et al. | 208/177 |
| 4,217,201 | 8/1980 | Chervenak | 208/8 R |
| 4,227,994 | 10/1980 | Knebel et al. | 208/177 |
| 4,242,102 | 12/1982 | Snell | 208/8 R X |
| 4,399,314 | 8/1983 | Child | 208/11 R X |
| 4,435,269 | 3/1984 | Gomory | 208/8 R |

*Primary Examiner*—Delbert E. Gantz
*Assistant Examiner*—Glenn A. Caldarola
*Attorney, Agent, or Firm*—Herbert L. Lerner; Laurence A. Greenberg

[57] ABSTRACT

Method of extracting liquid hydrocarbons from oil-containing stone or sand, wherein the oil-containing stone or the oil-containing sand undergoes hydrogenating, low temperature carbonization in a reactor at temperatures of 450° to 520° C. and a pressure of approximately 50 bar through the action of carbon monoxide, hydrogen and steam, and wherein the hydrocarbons are separated from the resulting gaseous, low temperature carbonization mixture. The low temperature carbonization mixture from the reactor is cooled in a first separation stage to a temperature of approximately 350° C. to condense the less volatile hydrocarbons. The separated, liquid phase is fed to a solids separator and placed in contact with a circulating gas of carbon dioxide and a $C_6/C_7$ hydrocarbon fraction. The low temperature carbonization mixture containing uncondensed gases and more volatile hydrocarbons are washed in a second separation stage with water and cooled to approximately 250° C. Gas containing hydrogen separated from the volatile hydrocarbons is fed at least partly to the reactor again. Carbon monoxide is obtained from the solids through the action of carbon dioxide, contained in hot, combustion gases. This carbon monoxide together with carbon dioxide of the combustion gases is fed to the reactor.

10 Claims, 1 Drawing Figure

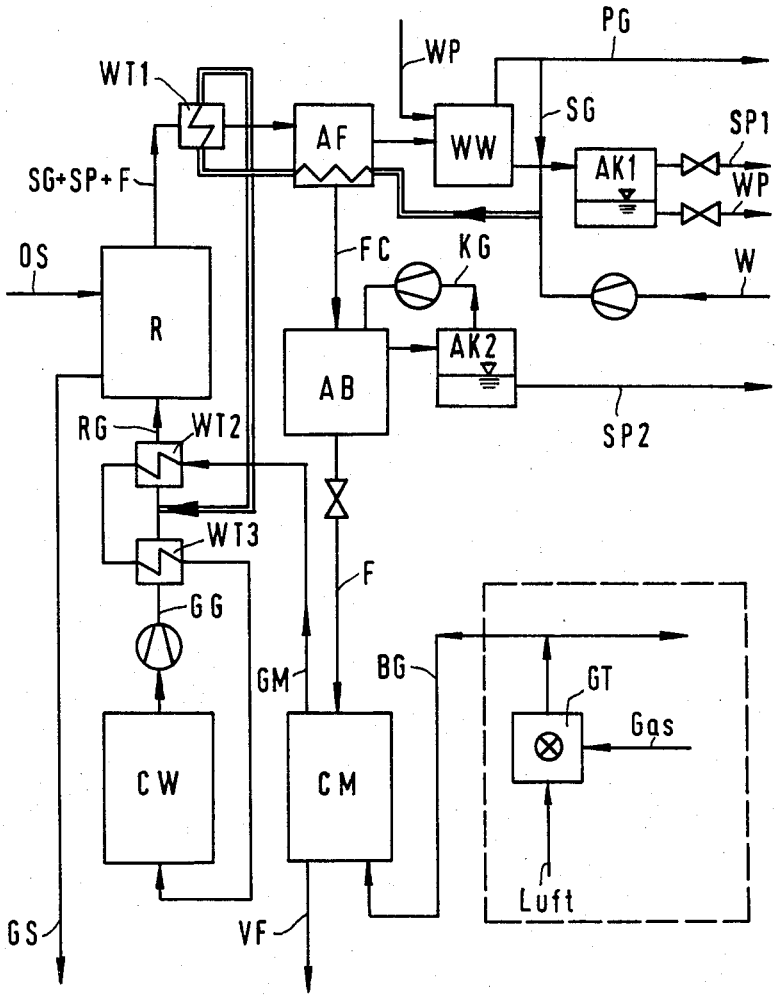
PG
WP
WT1
SG
AF
WW
SP1
AK1
WP
SG+SP+F
OS
FC
KG
W
R
AK2
AB
RG
WT2
SP2
WT3
F
GG
GM
BG
GT
Gas
CW
CM
Luft
GS
VF

METHOD OF EXTRACTING HYDROCARBONS FROM OIL-CONTAINING ROCK OR SAND THROUGH HYDROGENATING LOW TEMPERATURE CARBONIZATION

BACKGROUND OF THE INVENTION

1. Field of the Invention

The invention relates to extracting hydrocarbons from oil-containing rock and sand and more particularly refers to a new and improved process for the recovery of hydrocarbons from oil sands and oil shale involving low temperature carbonization with hydrogenation.

2. Description of the Prior Art

Considerable reserves of crude oil are stored in oil sands and oil shale. The extraction of oil from these reserves is associated with, amongst other things, high costs for separating the oil from sand or shale. Endeavours are being made, therefore, to develop the technical processes necessary for the hydrocarbon extraction, more advantageously in respect of the mode of operation, use of material and energy comsumption.

In a known method of extracting oil from oil sand or oil shale the latter undergoes hydrogenating, low temperature carbonization in a reactor, i.e. subjected to a relatively low temperature in the presence of hydrogen. In this case carbon monoxide and hydrogen, which are produced by the partial oxidation of uncondensed gaseous by-products separated from the liquid products in the process, act upon the mechanically prepared starting material, i.e. oil sand or oil shale which is mechanically reduced to a desired size, and in some cases impurities removed. In order to improve the yield of crude oil, water or steam can be additionally supplied to the reactor. A gaseous, low temperature carbonization mixture is drawn off from the reactor and subjected to condensation. In order in this process to separate out solid particles contained in the mixture, in the course of the condensation it is necessary to reduce the pressure of the low temperature carbonization mixture at the same time as it is cooled. The circulating, low-temperature carbonization gas must subsequently be compressed again (U.S. Pat. No. 3 617 472).

SUMMARY OF THE INVENTION

An object of the invention is to provide an efficient method of extracting liquid hydrocarbons from oil shale and oil sands involving hydrogenating, low temperature carbonization through the action of carbon monoxide, hydrogen and steam in a reactor from which is withdrawn an effluent containing as a by-product solid carbonaceous particles.

A particular object of the invention is to reduce energy expenditure for the preparation of the hydrogen which is required for the hydrogenating, low temperature carbonization by efficient utilization of the solids which are separated out in the course of the condensation of the gaseous, low temperature carbonization mixture which is withdrawn as effluent from the reactor.

With the foregoing and other objects in view, there is provided in accordance with the invention a method of recovering liquid hydrocarbons from oil-containing solid minerals selected from the group consisting of oil shale and oil sands which comprises (a) subjecting the oil-containing solid minerals to hydrogenating, low temperature carbonization by contact with hydrogen, carbon monoxide and steam in a reactor at temperature of 450° to 520° C. and a pressure of about 50 to 150 bar, (b) discharging from the reactor an effluent which is a mixture of normally (at standard temperature and pressure) gaseous constituents containing hydrogen, carbon monoxide, carbon dioxide and methane, water vapor, normally (at standard temperature and pressure) liquid low boilng hydrocarbons, normally (at standard temperature and pressure) liquid high boiling hydrocarbons, and solid particles containing combustible carbonaceous material and non-combustible minerals, (c) cooling the reactor effluent to a temperature of 350±25° C. to effect condensation of the normally liquid high boiling hydrocarbons and separating the condensed high boiling hydrocarbons which have suspended therein the solid particles from the remainder of the effluent which is a mixture of the gaseous constituents, water vapor and vaporous low boiling hydrocarbons, (d) scrubbing the mixture of the gaseous constituents, water vapor and vaporous low boiling hydrocarbons with water under pressure and cooling to a temperature of 250± 25° C. sufficient to condense the vaporous low boiling hydrocarbons and remove at least in part carbon dioxide and carbon monoxide by solution in the water, (e) separating the uncondensed gaseous constituents containing hydrogen from the condensate of low boiling hydrocarbons and water and returning at least a portion of the uncondensed gaseous constituents containing hydrogen to the reactor, (f) subjecting the condensate of high boiling hydrocarbons containing suspended solids to a solids separation by contact with a circulating gas of carbon dioxide and a $C_6/C_7$ hydrocarbon fraction to effect settling of the suspended solids, (g) withdrawing the settled solids and subjecting the solids to contact with hot combustion gases containing carbon dioxide to effect reaction of the carbonaceous material in the solids with the carbon dioxide in the hot combustion gases to produce carbon monoxide, (h) and directing the gases containing carbon monoxide and carbon dioxide from reaction of the hot combustion gases with the carbonaceous solids to the reactor.

Other features which are considered as characteristic for the invention are set forth in the appended claims.

Although the invention is illustrated and described herein as embodied in a method of extracting hydrocarbons from oil-containing rock or sand through hydrogenating, low temperature carbonization, it is nevertheless not intended to be limited to the details shown, since various modifications may be made therein without departing from the spirit of the invention and within the scope and range of equivalents of the claims.

BRIEF DESCRIPTION OF THE DRAWING

The invention, however, together with additional objects and advantages thereof will be best understood from the following description when read in connection with the accompanying drawing which is a flow sheet diagrammatically illustrating the method of operation according to the invention.

Oil shale is fed into a reactor at 450°–520° C. and 50 bar wherein it is subjected to the action of a gaseous reaction mixture containing CO, $H_2$ and steam. A gaseous and vaporous mixture in which solids are suspended are released from the reactor as effluent. Unvaporized solid material consisting principally of non-combustible mineral matter is discharged from the reactor. The effluent is cooled to about 350° C. to condense and separate high boiling hydrocarbons in which the solid particles are suspended from the more volatile low boiling hydrocarbons and gaseous constituents. The low boiling hydrocarbons and gaseous constituents are washed with water and cooled to about 250° C. The gaseous constituents containing $H_2$ are separated from the condensate of low boiling hydrocarbons and water, which latter two separate into two layers and are separately withdrawn. A portion of the gaseous constituents containing $H_2$ are returned to the reactor but are first preheated by heat exchange with the effluent. The condensate of high boiling hydrocarbons having suspended therein solids containing carbonaceous solids, is cooled to about 250° C. and passed to a settler wherein the solids settle and are removed. The solids are passed into a chamber in contact with hot combustion gas at 600°–700° C., wherein the $CO_2$ in the combustion gas reacts with C of the solids to form CO. The resultant gases containing CO and $CO_2$ are sent to the reactor. If desired, these gases may first be washed to remove CO and $CO_2$, the latter compressed and directed into the reactor.

DETAILED DESCRIPTION OF THE INVENTION

In accordance with the invention the low temperature carbonization mixture from the reactor containing non-condensible gases, particularly hydrogen, water vapor, low boiling volatile hydrocarbons, high boiling relatively non-volatile hydrocarbons, and solid particles containing combustible carbonaceous material and non-combustible minerals is cooled in a first separation stage to a temperature of approximately 350° C. to effect separation of the low temperature carbonization mixture into a lower liquid phase containing the high boiling hydrocarbons and the solid particles suspended therein, and an upper phase containing the non-condensible gases, water vapor and the volatile hydrocarbons. The separated, liquid phase is fed to a solids separator and placed in contact with the circulating gas of carbon dioxide and a $C_6/C_7$ hydrocarbon fraction to effect separation of the solid particles and recovery of the high boiling hydrocarbons. The upper phase of the low temperature carbonization mixture is washed with water in a second separation stage and is cooled to approximately 250° C. to effect separation and recovery of the low boiling hydrocarbons. The separated non-condensible gases containing hydrogen are fed at least in part to the reactor. The solids separated from the high boiling hydrocarbons are subjected to the action of carbon dioxide contained in hot, combustion gases from a furnace. The carbon dioxide reacts with the carbonaceous material in the solids to produce carbon monoxide which is fed to the reactor together with the unreacted carbon dioxide of the combustible gases. The solids mineral matter is discharged as ash.

Thus, in the method according to the invention, the solids which are contained in the gaseous, low temperature carbonization mixture are separated without loss of pressure and are used to produce hydrogen, which is utilized for efficiently carrying out the low temperature carbonization process. Furthermore, the hydrogen which is contained in the low temperature carbonization mixture from the reaction is separated from the condensible hydrocarbons in the mixture without loss of pressure and directed for further processing or returned in whole or part to the reactor.

For further optimization of the process, the following measures may be used, individually or jointly:

The cooling of the low temperature carbonization mixture in the first separation stage takes place through counterflow of the supply of fresh water and hydrogen to the reactor. The heat content of the low temperature carbonization gases is thereby to a considerably extent recovered with a saving in energy.

The gas which is circulated following the first separation stage flows through a separator, which is cooled to approximately 250° C., in order to separate the gas from the relatively non-volatile hydrocarbons. Final separation of the solid particles from the crude oil thereby takes place.

The washing liquid of the second separation stage is separated in a settling tank into an aqueous and an organic phase. Final separation of the crude oil from the water which is obtained in the process thereby takes place. Carbon monoxide and carbon dioxide which results from the action of the hot, combustible gases upon the solid parts are washed out of the gas mixture. Subsequently, after condensation they flow in counterflow to the gas mixture through one or more heat exchangers. The combustion gases of an additional furnace are thereby utilized in order to produce the carbon monoxide required for the low temperature carbonization process and to heat it to the required temperature. Advantageously, the hot, combustion gases which are used for this are taken from the waste gas of an adjacent power station of which the generator is driven by a gas turbine or by a steam turbine.

The process in accordance with the invention will be described in greater detail with reference to the drawing.

Mechanically prepared oil shale OS and also a gaseous reaction mixture RG, containing principally carbon monoxide, hydrogen and steam, are fed to a reactor R. At temperatures of approximately 450° to 520° C. and under a pressure of 50 bar a gaseous, low temperature carbonization mixture is produced which is drawn off at the top from the reactor R and which is a mixture of normally gaseous constituents SG containing $H_2$, CO, $CO_2$ and methane, water vapor, vaporous reaction products which contain a fraction of normally liquid low boiling hydrocarbons and a fraction of normally liquid high boiling hydrocarbons and fine, solid particles F in the form of carbonaceous and mineral products of the oil shale OS, which are carried along in the effluent from the reactor R. Separation of this low temperature carbonization mixture from reactor R into its various constituents takes place by reducing the temperature in stages to obtain products of a desired boiling point.

The low temperature carbonization mixture flows through a heat exchanger WT1 and then passes to a first separation stage AF wherein by countercurrent indirect heat exchange with fresh water W and low temperature carbonization gas SG, the mixture is further cooled to a temperature of approximately 350° C. As a result, the less volatile reaction products of the low temperature carbonization with boiling temperatures above 250° C. at normal pressure and with critical temperatures above 450° C. are separated by condensation. The resulting liquid phase FC of high boiling liquid hydrocarbons largely contains the solids of fine, mineral constituents and carbonaceous materials of the low temperature carbonization mixture. This liquid phase is passed for solids separation into the settling apparatus AB wherein it is brought into contact with a circulating gas KG. This gas contains principally carbon dioxide and a $C_6/C_7$ hydrocarbon fraction. In the resulting fluid mixture the fine, solid particles precipitate so quickly through the reduced viscosity and through agglomeration that a solids-free flow can be drawn off continuously at the head of the settling apparatus, which consists of the circulating gas and of not easily volatilized hydrocarbons dissolved therein. A solids-containing flow can be drawn off, likewise continuously, from the sump of the settling apparatus AB, which consists of mineral constituents, the residual carbon of the kerogen which is taken from the oil shale, and of the coke which is produced during low temperature carbonization.

The solids-free flow of circulating gas and high boiling hydrocarbons of relatively low volatility dissolved therein is cooled to approximately 250° C. and is fed to a separator AK2 wherein the relatively non-volatile hydrocarbons can be drawn off as liquid product SP2. The gas KG, which is thus regenerated, is returned to the settling apparatus AB.

The gaseous, low temperature carbonization mixture, which remains after the first separation stage AF, is subsequently fed to the sump of a water washer WW wherein the low temperature carbonization mixture is washed in counterflow with water at a temperature which is 20° to 30° C. below the saturation temperature of the water and at a pressure which corresponds to the low temperature carbonization pressure. In addition to the hydrocarbons, water-soluble impurities such as sulphur- and nitrogen compounds which may be in the gaseous mixture are also thereby removed from the low temperature carbonization mixture. The washing liquid is subsequently separated in the separator AK1 into an aqueous phase WP and an organic phase SP1 containing the relatively volatile low-boiling hydrocarbons. The aqueous phase is regenerated by expansion and is subsequently used as washing liquid again. The organic phase is also expanded, and the liquid portion is supplied as product fraction for further processing.

The gas, which is washed in the water washer WW, is separated into a product gas PG and into a low temperature carbonization gas SG, the latter containing hydrogen is fed together with fresh water W to the reactor R.

The solids flow F, which is extracted from the settling apparatus AB, is further used to convert it into carbon monoxide. To this end, the solids flow and the hot, combustible gases BG of a furnace are fed wholely or partly to the reactor CM, which is preferably a fluidized reactor and wherein the carbon dioxide of the hot, combustible gases BG is reacted at temperatures of approximately 600° to 700° C. with the carbon of the solids flow F. Carbon monoxide is thereby produced is accordance with the known Boudouard reaction, for example approximately 38% is produced at a temperature of 650°. In this process for extracting carbon monoxide from the residual carbon of the kerogen and the coke produced during low temperature carbonization, the high proportion of minerals in the solids flow acts as a catalyst to promote the reaction. Cheap, disposable catalysts can be added if necessary. The used up solids which after consumption of the carbonaceous material to form carbon monoxide are discharged from reactor CM through line VF. A gas mixture GM, which contains carbon monoxide, carbon dioxide and nitrogen, also leaves the reactor CM and is cooled in the heat exchangers WT2 and WT3 and subsequently fed to a gas washer CW wherein carbon monoxide and carbon dioxide are washed out. The gas mixture GG of carbon monoxide and carbon dioxide is subsequently compressed with the aid of a compressor to the pressure of the hydrogenating, low temperature carbonization and, in addition, heated in the heat exchanger WT3. Together with the low temperature carbonization gas SG and steam, the gas GG is subsequently fed into the reactor R via the heat exchanger WT2.

Low temperature carbonization of the oil shale in the reactor R takes place at temperatures of 400° to 500° C. and pressures up to 150 bar under the action of the gas mixture RG containing hydrogen, steam, carbon monoxide and carbon dioxide. Hydrogen and carbon dioxide are thereby produced from the steam and carbon monoxide supplied, in accordance with the water-gas equilibrium and with the relation $$CO+H_2O \rightleftharpoons CO_2+H_2$$

where, at high temperatures, the equilibrium is displaced towards the left, at relatively low temperatures of low temperature carbonization it is on the right side. The hydrogen which is necessary for hydrogenating, low temperature carbonization is thereby produced in the low temperature carbonization reactor R. Surplus hydrogen can be used after the separating process as hydrogenation hydrogen PG for upgrading and refining the products or can be discharged as a product of the process without any further processing.

The combustion gases BG, which are fed to the reactor CM, are either taken from a special furnace or otherwise from the exhaust gases of a power station which also provides the electrical energy which is required for the process and which is a gas turbine power station with the gas turbine GT or a conventional steam turbine power station.

The foregoing is a description corresponding, in substance, to German application No. P 32 36 504.7, dated Sept. 29, 1982, international priority of which is being claimed for the instant application, and which is hereby made part of this application. Any material discrepancies between the foregoing specification of the aforementioned corresponding German application are to be resolved in favor of the latter.

We claim:

1. Method of recovering liquid hydrocarbons from oil-containing solid minerals selected from the group consisting of oil shale and oil sands which comprises (a) subjecting the oil-containing solid minerals to hydrogenating low temperature carbonization by contact with hydrogen, carbon monoxide and steam in a reactor at temperatures of 450° to 520° C. and a pressure of about 50 to 150 bar, (b) discharging from the reactor an effluent which is a mixture of normally (at standard temperature and pressure) gaseous constituents containing hydrogen, carbon monoxide, carbon dioxide and ethane, water vapor, normally (at standard temperature and pressure) liquid low boiling hydrocarbons, normally (at standard temperature and pressure) liquid high boiling hydrocarbons, and solid particles containing combustible carbonaceous material and non-combustible minerals, (c) cooling the reactor effluent to a temperature of 350°±25° C. to effect condensation of the normally liquid high boiling hydrocarbons and separating the condensed high boiling hydrocarbons which have suspended therein the solid particles from the remainder of the effluent which is a mixture of the gaseous constituents, water vapor and vaporous low boiling hydrocarbons (d) scrubbing the mixture of the gaseous constituents, water vapor and vaporous low boiling hydrocarbons with water under pressure and cooling to a temperature of 250°±25° C. sufficient to condense the vaporous low boiling hydrocarbons and remove at least in part carbon dioxide and carbon monoxide by solution in the water, (e) separating the uncondensed gaseous constituents containing hydrogen from the condensate of low boiling hydrocarbons and water and returning at least a portion of the uncondensed gaseous constituents containing hydrogen to the reactor, (f) subjecting the condensate of high boiling hydrocarbons containing suspended solids to a solids separation by contact with a circulating gas of carbon dioxide and a $C_6/C_7$ hydrocarbon fraction to effect settling of the suspended solids, (g) withdrawing the settled solids and subjecting the solids to contact with hot combustion gases containing carbon dioxide to effect reaction of the carbonaceous material in the solids with the carbon dioxide in the hot combustion gases to produce carbon monoxide, (h) and directing the gases containing carbon monoxide and carbon dioxide from reaction of the hot combustion gases with the carbonaceous solids to the reactor.

2. Method according to claim 1, wherein coooing of the reactor effluent to effect condensation of the high boiling hydrocarbons is effected by passing the effluent in indirect heat exchange with fresh water and said returning uncondensed gaseous constituents containing hydrogen (e) before entering the reactor.

3. Method according to claim 1, wherein the circulating gas of carbon dioxide and $C_6/C_7$ hydrocarbon fraction (g) flow together with high boiling hydrocarbons to a separator and are cooled to a temperature of 250°±25° C. to condense the high boiling hydrocarbons which form a liquid layer, separating the liquid layer from the circulating gas above it, discharging the liquid layer and recirculating the circulating gas.

4. Method according to claim 1, wherein the condensate of low boiling hydrocarbons and water are separated into an aqueous lower liquid layer and a liquid organic layer containing the hydrocarbons above the aqueous lower liquid layer, and discharging the organic layer and the aqueous layer as separate products.

5. Method according to claim 3, wherein the condensate of low boiling hydrocarbons and water are separated into an aqueous lower liquid layer and a liquid organic layer containing the hydrocarbons above the aqueous lower liquid layer, and discharging the organic layer and the aqueous layer as separate products.

6. Method according to claim 1, wherein the gases containing carbon dioxide and carbon monoxide from reactin of the hot combustion gases with the carbonaceous solids are washed to remove carbon dioxide and carbon monoxide, the carbon dioxide and carbon monoxide compressed, preheated by heat exchange and directed to the reactor.

7. Method according to claim 3, wherein the gases containing carbon dioxide and carbon monoxide from reaction of the hot combustion gases with the carbonaceous solids are washed to remove carbon dioxide and carbon monoxide, the carbon dioxide and carbon monoxide compressed, preheated by heat exchange and directed to the reactor.

8. Method according to claim 1, wherein the hot combustion gases containing carbon dioxide are taken from the exhaust gas of an adjacent power plant.

9. Method according to claim 6, wherein the hot combustion gases containing carbon dioxide are taken from the exhaust gas of an adjacent power plant.

10. Method according to claim 7, wherein the hot combustion gases containing carbon dioxide are taken from the exhaust gas of an adjacent power plant.

* * * * *